US011719387B2

(12) United States Patent
Shamoun et al.

(10) Patent No.: US 11,719,387 B2
(45) Date of Patent: Aug. 8, 2023

(54) LIQUID CONDITIONING FOR CRYOGEN VESSEL FILL STATION

(71) Applicant: Messer Industries USA, Inc., Bridgewater, NJ (US)

(72) Inventors: Simon J. Shamoun, Acworth, GA (US); Isaiah Edmonds, West Windsor, NJ (US)

(73) Assignee: Messer Industries USA, Inc., New Castle, DE (US)

( * ) Notice: Subject to any disclaimer, the term of this patent is extended or adjusted under 35 U.S.C. 154(b) by 0 days.

(21) Appl. No.: 16/210,239

(22) Filed: Dec. 5, 2018

(65) Prior Publication Data

US 2020/0182407 A1 Jun. 11, 2020

(51) Int. Cl.

| | |
|---|---|
| ***F17C 7/02*** | (2006.01) |
| ***F17C 7/00*** | (2006.01) |
| ***F25D 29/00*** | (2006.01) |
| ***F17C 13/04*** | (2006.01) |

(52) U.S. Cl.

CPC ..... *F17C 7/00* (2013.01); *F17C 13/04* (2013.01); *F25D 29/001* (2013.01); *F17C 2201/0104* (2013.01); *F17C 2205/0323* (2013.01); *F17C 2221/011* (2013.01); *F17C 2221/014* (2013.01); *F17C 2221/016* (2013.01); *F17C 2223/0161* (2013.01); *F17C 2223/033* (2013.01); *F17C 2250/043* (2013.01); *F17C 2250/0443* (2013.01); *F17C 2250/0626* (2013.01); *F17C 2250/0689* (2013.01); *F17C 2250/07* (2013.01); *F17C 2260/02* (2013.01)

(58) Field of Classification Search

CPC ..... F17C 2221/011; F17C 2221/014; F17C 2221/016; F17C 2223/033; F17C 2250/07; F17C 13/025; F17C 2250/0631; F17C 2250/0626; F17C 2250/043; F17C 2250/0689

USPC ..... 62/48.1, 48.2

See application file for complete search history.

(56) References Cited

U.S. PATENT DOCUMENTS

| | | | | |
|---|---|---|---|---|
| 2,576,985 A * | 12/1951 | Wildhack | F17C 9/02 | 62/50.2 |
| 2,978,876 A * | 4/1961 | Pastuhov | F17C 13/02 | 62/48.2 |
| 3,144,036 A * | 8/1964 | Rice, Jr. | F17C 13/025 | 137/12 |
| 3,245,248 A * | 4/1966 | Ritter | G05D 23/1919 | 165/289 |
| 3,253,611 A * | 5/1966 | Cummins | G05D 16/02 | 137/338 |

(Continued)

FOREIGN PATENT DOCUMENTS

WO WO-2013081979 A1 * 6/2013 ..... F25J 1/0025

OTHER PUBLICATIONS

Duroudier J.-P., Thermodynamics, 2016, Elsevier Ltd , pp. 51-106.*

*Primary Examiner* — John F Pettitt, III
(74) *Attorney, Agent, or Firm* — Joshua L. Cohen

(57) ABSTRACT

A method for conditioning a liquid cryogen in a tank includes reducing a pressure of the liquid cryogen in the tank for reducing a temperature of the liquid cryogen and condensing any vapor boil-off in the tank for reclaiming the liquid cryogen in the tank. The liquid cryogen may be selected from the group consisting of liquid nitrogen (LIN), liquid oxygen (LOX), and liquid argon (LAR).

5 Claims, 3 Drawing Sheets

(56) References Cited

U.S. PATENT DOCUMENTS 3,864,928 A * 2/1975 Eigenbrod ..... F17C 9/02 62/48.1
4,018,582 A * 4/1977 Hinds ..... F17C 9/00 62/50.4
4,475,348 A * 10/1984 Remes ..... F17C 9/00 141/5
5,370,112 A * 12/1994 Perkins ..... H02K 7/1884 128/204.21
5,373,702 A * 12/1994 Kalet ..... F17C 9/00 123/525
5,937,655 A * 8/1999 Weiler ..... F17C 7/04 62/50.1
9,395,048 B1 * 7/2016 Grayson ..... F17C 13/008
2002/0157402 A1 * 10/2002 Drube ..... F17C 5/02 62/50.1
2006/0086099 A1 * 4/2006 Dickerson ..... F25J 1/0017 62/47.1
2007/0006597 A1 * 1/2007 Zia ..... F17C 7/02 62/48.2
2008/0135108 A1 * 6/2008 Zuck ..... F23K 5/007 137/360
2008/0178610 A1 * 7/2008 Whitcher ..... A61M 16/14 62/48.1
2009/0071171 A1 * 3/2009 Zia ..... F17C 3/00 62/47.1
2011/0056238 A1 * 3/2011 Mak ..... F25J 1/0222 62/614
2014/0041398 A1 * 2/2014 Aoki ..... F25J 1/0025 62/48.2
2014/0158250 A1 * 6/2014 Downie ..... F17C 13/023 141/4
2015/0219393 A1 * 8/2015 Sauer ..... F17C 9/02 62/48.2
2016/0097489 A1 * 4/2016 Made ..... F25J 1/0244 62/50.5
2016/0195116 A1 * 7/2016 Foege ..... F17C 13/04 137/808
2016/0252215 A1 * 9/2016 Windmeier ..... F17C 5/02 62/49.1
2017/0059242 A1 * 3/2017 Boyd ..... F17C 13/00
2017/0276054 A1 * 9/2017 Shaaban ..... F17C 7/04
2018/0016130 A1 * 1/2018 Watts ..... B67D 7/3245
2018/0299072 A1 * 10/2018 Oury ..... F17C 13/025
2019/0248228 A1 * 8/2019 Wallengren ..... F02D 19/025
2019/0390822 A1 * 12/2019 Brothers ..... F17C 3/08
2020/0182459 A1 * 6/2020 Schreiner ..... F23D 14/22
2020/0240634 A1 * 7/2020 Ekman ..... F23C 6/047
2020/0256513 A1 * 8/2020 Brooks ..... F17C 1/12

* cited by examiner

BY DEPRESSURIZING (VENTING) TO 10 PSIG AND REPRESSURIZING TO 50 PSIG

BY DEPRESSURIZING (VENTING) TO 10 PSIG AND REPRESSURIZING TO 50 PSIG

LIQUID CONDITIONING FOR CRYOGEN VESSEL FILL STATION

BACKGROUND OF THE INVENTION

The present embodiments relate to apparatus and methods for re-conditioning cryogen liquid stored for use in tanks or vessels.

Liquid flow rates and therefore downstream processes are directly impacted by the quality or condition of the liquid in the storage tank and subsequently in the pipeline from the tank to the process. This is especially so for cryogen liquids.

Initially, a cryogen liquid is delivered at a subcooled temperature to a storage tank. Removal of the subcooled liquid from the tank while the liquid is at its initial subcooled temperature occurs at a relatively high flow rate toward downstream use of the liquid, i.e. application of the cryogen liquid to a product or a process. After a period of time has elapsed, the liquid in the storage tank begins to warm due to the normal heat leak at the tank such that the liquid approaches its saturation temperature. During this warming of the liquid, there will result a noticeable reduction in the flow rate of the liquid from the tank. This reduced flow rate is a result of the liquid vaporizing into a two-phase flow, i.e. cryogen liquid and cryogen vapor. The reduced flow rate can on occasion equate to only 1/3 to 1/5 of the flowrate at the same pressure as compared to when the liquid was subcooled.

Where liquid nitrogen (LIN) is the stored liquid for use, it will have a temperature at atmospheric pressure of −320° F. (−196° C.). Warming of the LIN due to heat leak at the tank causes the temperature of the LIN to rise to for example −290° F. (−179° C.), at which point the LIN will flash and the two-phase, reduced efficiency flow rate of the LIN will occur.

By re-conditioning or sub-cooling the LIN, the LIN flow from the tank can be returned to the original, high flow rate from the tank. This process used with a liquid tank, such as for example a LIN storage tank or vessel, is shown in FIGS. 1A and 1B, and is known in the industry for "conditioning" cryogen. Referring to FIG. 1A, during known practices, a cryogen (such as LIN) storage tank shown generally at "a" is at a head pressure of for example 50 psig to push or exert a force upon LIN "b" in the tank from proximate a bottom "c" of the tank into a pipe "d" for delivery to a subsequent user or customer process or equipment (not shown). The storage tank a is therefore freshly filled. The LIN b can be at a temperature of for example −312° F. (−191° C.), and the tank a may contain a volume of the LIN in a range of from 6,000-15,000 gallons (22,712-56,781 litres). Initially, a temperature of the LIN b is uniform throughout a height and volume of the filled tank a. That is, the cooled temperature of the LIN b in the tank a is essentially uniform throughout its volume, the tank shown in FIG. 1A having been recently filled with fresh LIN to a position approaching a top "e" of the tank. The LIN b is shown filled to a level "f" within the tank a. A head or ullage space "g" at the top e of the tank a is provided to receive fresh or recirculated LIN, and as a volume or space into which pressure for the tank can be introduced.

As the LIN b is drained from or forced out of the tank a under pressure over a period of time, which may be for example 3-7 days depending upon the volume of usage of the LIN, heat leak occurs at the tank and in the LIN, resulting in temperature stratification occurring throughout a volume of the tank, as shown in FIG. 1B. For example, the temperature stratification over time of the LIN results in the LIN b proximate the bottom c remaining for the most part at or very close to −312° F., while the temperature progressively increases through the volume of the LIN closer to the top e of the tank a as the temperature of the LIN warms to approach for example −293° F. (−181° C.) at a warmed upper level "h" of the LIN in the tank.

The LIN b in the tank a of FIG. 1B is, however, still under a head pressure of 50 psig. Unfortunately, the flow from the tank a is now at a reduced rate due to the LIN b being in a two-phase flow, i.e. LIN and nitrogen vapor. Manually measuring the flow rate of the LIN b in the pipe d is therefore "after the fact", i.e. the flow rate has already deteriorated to a less desirable rate. In order to recondition the LIN b for an increased, more efficient flow rate from the tank a, the operator of the known systems has a few options, all of which add time and expense to the known systems. First, the operator may install a subcooler to chill the flow of liquid in-line prior to reaching each application point of the liquid. Second, the operator may install a phase separator to separate out the vapour from the liquid in the pipeline. Lastly, the operator may have the tank refilled with fresh, subcooled LIN for use thereof, which will unfortunately cause a noticeable amount of the LIN to again be lost to boil off and the operator having to contend with the depreciating flow rate as the fresh LIN begins to be exposed to heat leak again.

SUMMARY OF THE INVENTION

The present apparatus and method embodiments provide for a computing device that can determine saturation and subcooled liquid conditions of the fluid in the storage tank and in turn control the liquid's properties to ensure processing conditions downstream are maximized for efficiency and/or disruptions minimized due to unwanted saturated liquid flow. This program logic controller (plc) or similar process controlling device can be remotely monitored and aided with human intervention if necessary to assist if deliveries are enroute, in order to delay an upcoming cycle. The controller will be optimized to remotely run a reconditioning cycle (during non-production periods) and will be equipped with alarms to notify the customer of an upcoming flow disruption due to the quality of liquid in the storage tank.

The present embodiments automatically re-condition the LIN by incorporating a remote control feature to predict when to do so on the basis of anticipated production rates, current LIN conditions in the bulk tank, weather conditions and delivery schedules.

Therefore, the present embodiments improve the downstream processing control of the LIN by substantially reducing slowdown or flow inconsistency from day to day in the process by considering and taking into account heat leak.

The present embodiments also address the so-called "100 inch problem"; an efficiencies issue that operators perceive is necessary in order to maintain the necessary head pressure in the tank to accommodate anticipated boil off of the cryogen liquid. That is, in so doing allows the supplier to utilize a larger portion of the tank. Instead of maintaining a level above 100 inches of tank pressure, the operator can instead utilize the majority of the tank to improve their cost efficiencies.

Accordingly, there is provided herein a method embodiment for conditioning a liquid cryogen in a tank which includes reducing a pressure of the liquid cryogen in the tank for reducing a temperature of the liquid cryogen and condensing any vapor boil-off in the tank for reclaiming the liquid cryogen in the tank.

Another embodiment includes the method including re-pressurizing the liquid cryogen in the tank.

Another embodiment includes the method, wherein the liquid cryogen is selected from the group consisting of liquid nitrogen (LIN), liquid oxygen (LOX), and liquid argon (LAR).

Another embodiment includes the method, wherein the pressure of the tank is 50 psig, and the reducing the pressure is reduced to 10 psig.

Another embodiment includes the method, wherein the re-pressurizing is resumed to the pressure of 50 psig.

Another embodiment includes the method, wherein after the re-pressurizing a temperature of the liquid cryogen is uniformly consistent throughout the tank.

Another embodiment includes the method, wherein the reducing the pressure and the re-pressurizing the liquid cryogen occurs automatically.

Another embodiment includes the method further including supporting the tank off an underlying surface for protecting the tank.

BRIEF DESCRIPTION OF THE DRAWINGS

For a more complete understanding of the present invention, reference may be had to the following description of exemplary embodiments considered in connection with the accompanying drawing Figures, of which.

DETAILED DESCRIPTION OF THE INVENTION

Before explaining the inventive embodiments in detail, it is to be understood that the invention is not limited in its application to the details of construction and arrangement of parts illustrated in the accompanying drawings, if any, since the invention is capable of other embodiments and being practiced or carried out in various ways. Also, it is to be understood that the phraseology or terminology employed herein is for the purpose of description and not of limitation.

In the following description, terms such as a horizontal, upright, vertical, above, below, beneath and the like, are to be used solely for the purpose of clarity illustrating the invention and should not be taken as words of limitation. The drawings are for the purpose of illustrating the invention and are not intended to be to scale.

The predictive and computational abilities of the apparatus and method embodiments of the present invention provide for an automated and/or remote ability to re-condition a cryogenic liquid, such as LIN, at for example a customer station.

Figure 2:
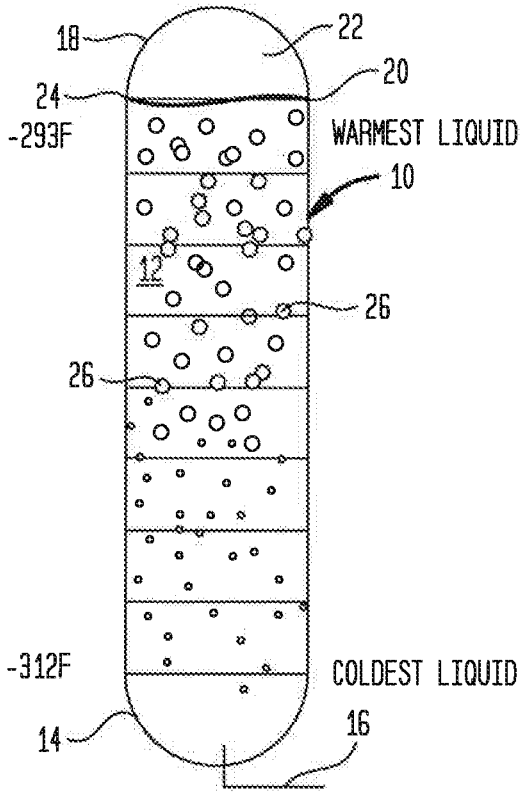
FIGS. 2 and 3 show side plan schematic views of apparatus embodiments for implementing method embodiments according to the present invention and which can be used with the tanks of FIGS. 1A and 1B.
Figure 3:
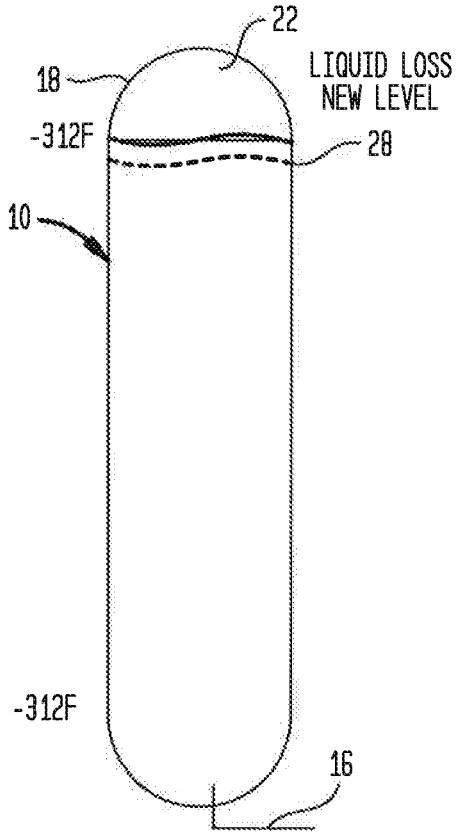
Figure 4:
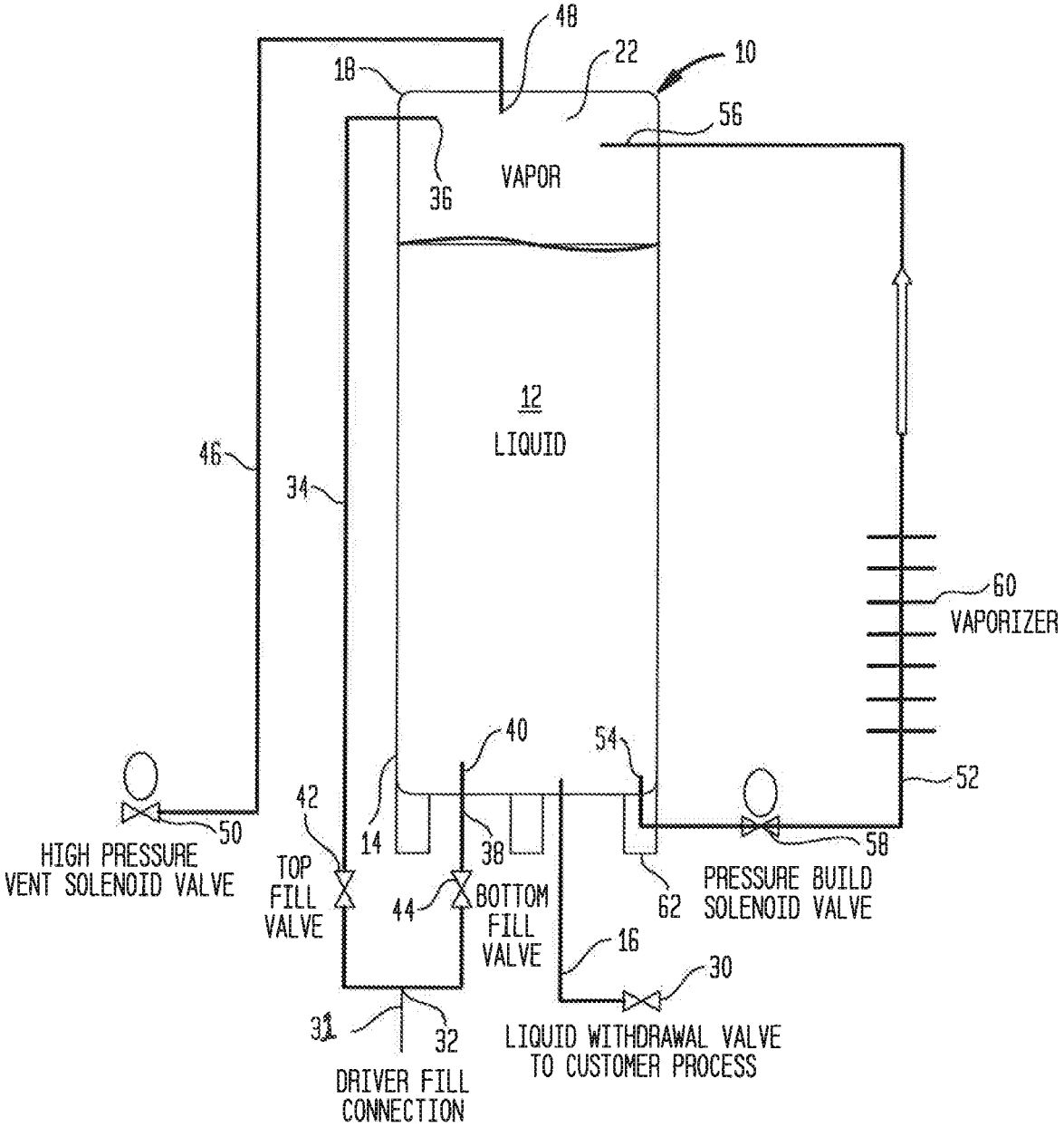
FIG. 4 shows a side plan schematic view of connections for the tanks of FIGS. 2 and 3.

Embodiments of the present invention are illustrated in FIGS. 2-4. Advantages of the present method embodiments include: a more consistent liquid quality at point of use; the ability to operate the liquid storage tank to a lower level of liquid in same, and to deliver more fully loaded trucks of LIN (rather than partial loads to the bulk storage LIN tank); a reduction in two-phase flow from the storage tank to the downstream process, and a related increase in cost savings; reliably more consistent chill times for batch type processes; and a potential reduction in pipe size and less capital spend on same for a commensurate amount of liquid movement.

Referring to FIG. 2, a cryogen (such as LIN) storage tank shown generally at 10 is at a head pressure of for example 50 psig to push or exert a force upon LIN 12 in the tank from proximate a bottom 14 of the tank into a pipe 16 for delivery to a subsequent user or customer process or equipment (not shown). The LIN 12 can be at a temperature of for example −312° F. (−191° C.), and the tank 10 may contain a volume of the LIN in a range of from, for example, 6,000-15,000 gallons (22,712-56,781 litres). This volume may of course be smaller or larger depending upon the particular application process being employed. Initially, a temperature of the LIN 12 is uniform throughout a height and volume of the tank 10. That is, the cooled temperature of the LIN 12 in the tank 10 is essentially uniform throughout its volume, such as when the tank is recently filled with fresh LIN to a position approaching a top 18 of the tank. In FIG. 2, the LIN 12 is shown filled to a level 20 within the tank 10. A head or ullage space 22 at the top 18 of the tank 10 above the LIN 12 is provided to receive fresh or recirculated LIN, and as a volume into which pressure for the tank can be introduced.

As the LIN 12 is drained from or forced out of the tank 10 under pressure over a period of time, which may be for example 3-7 days depending upon the volume of usage of the LIN, heat leak occurs at the tank and in the LIN, resulting in temperature stratification occurring throughout a volume of the tank, as shown in FIG. 2. For example, the temperature of the LIN 12 proximate the bottom 14 remains for the most part at or very close to −312° F. (coldest liquid), but the temperature progressively increases through the volume of the LIN closer to the top 18 of the tank as the temperature of the LIN warms to approach for example −293° F. (−181° C.) at a warmed upper level 24 (warmest liquid) of the LIN in the tank.

Figure 1A:
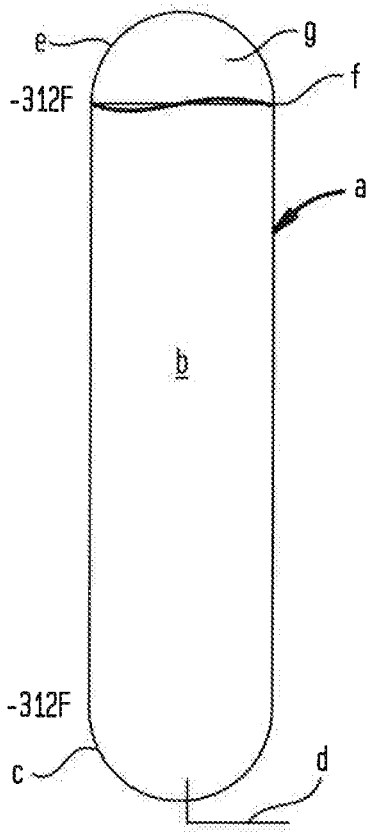
FIG. 1A (PRIOR ART)
FIGS. 1A and 1B show side plan schematic views of a known conditioning system for use with known liquid cryogen tanks.
Figure 1B:
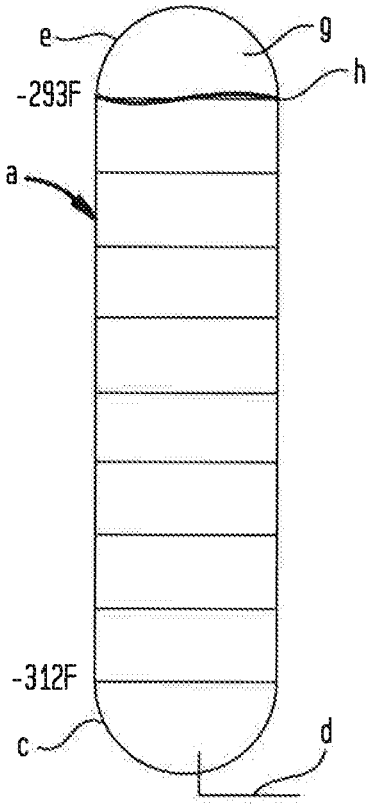
FIG. 1B (PRIOR ART)

Still referring to FIG. 2, the LIN 12 in the tank 10 has warmed during use due to heat leak effecting same and therefore, temperature stratification of the LIN similar to that which occurred with respect to the LIN b in the tank a (FIG. 1A). However, instead of providing fresh LIN to the tank 10 to replenish same, the operator de-pressurizes the tank from 50 psig down to for example 10 psig. This reduction in pressure will result in a decrease in the LIN temperature. Accordingly, boil-off vapour shown generally at 26 of the LIN 12 occurs due to the de-pressurization of same and therefore, the temperature of the LIN will also be reduced to recondition the LIN as shown in FIG. 3 for subsequent use without having to resort to an immediate refilling of the tank 10 with fresh LIN. The amount of time that elapses from the condition of the tank 10 in FIG. 2 until the tank condition in FIG. 3 can be for example 15 minutes to a few hours, depending upon the pressure differential. However, due to heat leak and the fact that not all of the vaporized LIN will be reclaimed after re-pressurization, there is a new level 28 (a re-conditioned level) of the LIN 12 in the tank 10, and the new level is lower than the level 24 before additional LIN is added to the tank, as shown in FIG. 3.

FIG. 4 shows the tank 10 with the LIN 12 therein, and piping connections for filling, emptying and pressurizing the tank for an end user, such as for example a customer filling station.

The tank 10 as described above with respect to FIGS. 2-3 includes the pipe 16 for withdrawing the LIN from the bottom 14 of the tank to a customer process or other equipment (not shown). A valve 30 is interposed in the pipe 16 for controlling a flow of the LIN through the pipe to the process. The pipe 16 may be connected, by way of example only, to food processing equipment for chilling and freezing applications with the LIN.

A fill connection pipe 31 may be used by a driver of a bulk delivery trailer (not shown) to fill the tank 10 being used as a customer storage tank for the LIN. The fill connection pipe 31 is branched or split at 32 into two separate lines, i.e. a top fill line 34 having an end 36 terminating in and in fluid communication with the head space 22 to provide the LIN to the top of the tank, and a bottom fill line 38 having an end 40 terminating in and in fluid communication with the LIN 12 in the tank near the bottom 14 to provide the LIN to the tank, or to fill the tank from the bottom up. The fill connection pipe 31 can have a standard coupling (not shown) constructed to releasably engage a corresponding coupling of a driver's tanker truck (not shown) delivering the LIN. The top fill line 34 is provided with a valve 42, and the bottom fill line 38 is provided with a valve 44. The valves 42,44 permit an operator of the tank 10 to determine into which volume of the LIN 12 in the tank 10 that the fresh, replenishing LIN is to be received. Top filling of the tank 10 may reduce the vapor pressure in same, and controls the tank storage pressure during the filling process.

A pressure-vent line 46 has an end 48 terminating in and in fluid communication with the head space 22 of the tank 10. An opposite end of the line 46 includes a valve 50, such as for example a solenoid valve, for controlling pressure at the head space 22 and therefore, in the tank 10 by being constructed to vent pressure in the tank in excess of what is needed in same. The valve 50 vents to atmosphere external to the tank 10 to prevent uncontrollable pressure increases in the tank, and to maintain pressure in the tank within a range of from +/−15 psig of the bulk tank set pressure, but set as close as possible to minimize the pressure differential.

A pressure line 52 includes a first end 54 terminating in and in fluid communication with the LIN 12 at the bottom 14 of the tank 10, and a second end 56 terminating in and in fluid communication with the head space 22 of the tank. A valve 58 is interposed in the line 52 to control pressure in the tank when such pressure gets too low. The pressure line 52 passes through and is in contact with a vaporizer 60. When pressure in the tank 10 drops to a lower, unacceptable level, the valve 58 is opened to draw the LIN 12 from the bottom 14 of the tank and causes the LIN to be vaporized when passing through the vaporizer 60 so that the vapour/gas is introduced into the top 18 of the tank through the second end 56 to be distributed into the head space 22 to increase pressure in the tank.

Struts 62 or legs support the tank 10 off an underlying surface (not shown), such as for example a floor, pad, skid, etc. The struts 62 may each be adjustable to accommodate any irregularities of the underlying surface.

By adding the remote control feature with respect to a flow disruption resulting from the quality of the liquid in the storage tank, the operator has the ability to remotely (online or at a remote delivery scheduling center) activate a re-conditioning cycle or de-activate a cycle if a new delivery is enroute. The remote control method, at its most basic level, will analyse properties of the LIN in the tank by measuring temperature, head space pressure, liquid pressure and liquid level. With these measurements, thermodynamic equations of equilibrium can be applied to understand if the LIN in the tank exists in a saturated or subcooled state. This in turn is one metric for providing guidance to an operator and the system itself in determining if it is necessary to perform a reconditioning cycle for the LIN.

The system through its processor can also "learn" about the customer usage rates and idle time of the tank 10. This is realized through monitoring the following variables over time: tank head space pressure, tank bottom pressure, LIN temperature, liquid level in tank, daily and weekly operating schedules of the customer, and weather conditions. Such can assist with predicting the next re-conditioning cycle of the LIN 12 by understanding the period of time necessary for a subcooled state of the LIN to last in the tank 10 before the LIN needs to be re-conditioned.

It will be understood that the embodiments described herein are merely exemplary, and that a person skilled in the art may make variations and modifications without departing from the spirit and scope of the invention. All such variations and modifications are intended to be included within the scope of the invention as provided in the appended claims. It should be understood that the embodiments described above are not only in the alternative, but can be combined.

What is claimed is:

1. A method for conditioning a liquid cryogen in a tank, comprising:

reducing a pressure of the liquid cryogen in the tank by venting vapor in the tank to atmosphere external to the tank to cool the liquid cryogen in the tank, wherein the pressure of the tank is reduced from 50 psig to 10 psig, withdrawing the liquid cryogen from the tank to a vaporizer, vaporizing the liquid cryogen with the vaporizer for providing vapor boil-off, and introducing the vapor boil-off from the vaporizer into the tank for re-pressurizing the tank with the vapor boil-off, wherein the reducing, the withdrawing, and the introducing steps condition the liquid cryogen in the tank to a new level lower than a liquid level of the liquid cryogen that existed in the tank before the reducing the pressure of the liquid cryogen in the tank.

2. The method of claim 1, wherein the liquid cryogen is selected from the group consisting of liquid nitrogen (LIN), liquid oxygen (LOX), and liquid argon (LAR).

3. The method of claim 1, wherein the re-pressurizing the tank is resumed to 50 psig.

4. The method of claim 1, wherein after the re-pressurizing a temperature of the liquid cryogen is uniform throughout the tank.

5. The method of claim 1, wherein the reducing the pressure and the re-pressurizing the liquid cryogen in the tank occurs automatically.

* * * * *